United States Patent [19]

Blattler

[11] 4,147,046

[45] Apr. 3, 1979

[54] HEAVY DUTY MOBILE PIPE STRAIGHTENING MACHINE OF RELATIVELY LIGHT-WEIGHT CONSTRUCTION

[75] Inventor: Joe F. Blattler, Edmonton, Canada

[73] Assignee: International Tool and Supply Co. Inc., Houston, Tex.

[21] Appl. No.: 870,039

[22] Filed: Jan. 16, 1978

Related U.S. Application Data

[63] Continuation of Ser. No. 717,002, Aug. 23, 1976, abandoned.

[51] Int. Cl.[2] ..... B21D 3/04

[52] U.S. Cl. ..... 72/68; 72/98; 72/99; 72/110

[58] Field of Search ..... 72/67, 68, 95, 98, 99, 72/100, 110, 111

[56] References Cited

U.S. PATENT DOCUMENTS

| | | | |
|---|---|---|---|
| 2,550,842 | 5/1951 | McClure et al. | 72/121 |
| 2,642,113 | 6/1953 | Kenney et al. | 72/98 |
| 3,706,215 | 12/1972 | Horton | 72/99 |

FOREIGN PATENT DOCUMENTS

| | | | |
|---|---|---|---|
| 831323 | 1/1970 | Canada | 72/98 |
| 1926610 | 11/1970 | Fed. Rep. of Germany | 72/110 |

*Primary Examiner*—Lowell A. Larson
*Attorney, Agent, or Firm*—Arnold, White & Durkee

[57] ABSTRACT

A mobile pipe straightening machine is of relatively light-weight construction for increased transportability and finds particular application for straightening drill pipe in the field. For minimizing the overall weight of the machine, a bed frame is provided in an elongate, trough-shaped, construction having first and second upstanding sides and a bottom member to define a bed space. At least one drive roll is swivelly supported within the bed space, and first and second idler rolls are movably coupled to the bed frame in spaced relationship with the one drive roll. Each idler roll is supported within a housing which in turn is supported within a dome-shaped support structure. A bushing having a key slot and a key for the key slot is disposed between the dome-shaped support structure and the housing. By keying the housing to the bushing and by providing a slot in the dome-shaped support structure, the bushing (and thus the housing and idler roll) can be rotated by control apparatus positioned laterally of the dome-shaped support structure rather than in a position overlying it, thereby reducing the height otherwise required. Other features include: (1) individual control of the upper idler rolls to allow roll straightening of hooked, upset ends of drill pipe; (2) gag press straightening using separate gag press mechanisms; and (3) an individually actuable inspection mechanism which allows the pipe to be elevated from the drive rolls and rolled for visual inspection while still in the passage.

33 Claims, 14 Drawing Figures

HEAVY DUTY MOBILE PIPE STRAIGHTENING MACHINE OF RELATIVELY LIGHT-WEIGHT CONSTRUCTION

This is a continuation of application, Ser. No. 717,002, filed Aug. 23, 1976 now abandoned.

BACKGROUND OF THE INVENTION

This invention relates to heavy duty pipe straightening machines in general and more particularly to mobile pipe straightening machines of the roll straightening type and which are particularly suited for use in the field.

Heavy duty pipe straightening machines historically have evolved from an ancient form using gag press principles to present day machines using spin straightening principles and roll (or cross-roll) straightening principles. A pipe straightening machine using the gag press principles, in simplified terms, incorporates a pair of spaced blocks for supporting the pipe and an overhead ram for exerting a transverse force on the pipe at a point intermediate the blocks. The pipe is bent in the transverse direction beyond straightness such that when the transverse pressure is removed, the pipe ideally is straight. This procedure, although having many advantages, also has disadvantages. For example, it crimps the pipe and repeated use puts a series of smaller bends in the pipe. The procedure also undesirably sets up stresses within the structure which usually cause microscopic cracks to develop, thereby weakening the pipe structure.

In an attempt to alleviate some of the problems associated with gag press principles, heavy duty machines using spin straightening principles evolved. These machines incorporated a series of lower drive rolls in combination with a series of overhead idler rolls. The respective rolls had contoured surfaces to accommodate the particular size of the pipe needing straightening. Rather sophisticated equipment was attached to the ends of the pipe for exerting pressures thereto which placed the pipe in tension. The equipment then caused the pipe to spin as it traversed between the lower and upper rolls. Such machines were not adapted for universally accommodating wide ranges of pipe diameters without changing of the rolls to ones having the proper surface contours.

Such pipe straightening machines using the described spin straightening principles have found generally satisfactory use in mills. Mills generally have high volumes of pipe having the same outside diameter and such ameliorates the characteristic of being non-universal. Also, spin straightening machines are ordinarily exclusively stationery in nature at the mills. Thus the fact that such machines were of unduly large weights and size was of little significance to mill usage.

To overcome the non-universal characteristic of spin straightening machines, the roll, or cross-roll, pipe straightening machines developed. These machines utilized lower drive rolls and upper idler rolls which were at a skewed orientation or angle with the axis formed by the passage of the pipe between the rolls. By adjusting the amount of skew, a wide range of pipe diameters could be accommodated without replacing the particular drive and idler rolls. Also, the roll type straighteners did not require the pipe needing straightening to be placed in tension.

Generally such roll straightening type pipe straightening machines also found applications in mills. Accordingly, the weights and sizes of such machines were often enormous, effectively preventing their being transportable for field applications.

Pipe straightening machines of the roll straightening type have now been developed capable of being transported to the field for straightening drill pipe. Once such machine is described in Canadian Pat. No. 831,323, entitled PIPE STRAIGHTENER, issued to Walter A. Johnson on Jan. 6, 1970. Although this pipe straightening machine was a considerable advance forward, it suffered from several drawbacks. It was unneedlessly heavy for the size of pipe it accommodated, thereby being unduly difficult to transport in the field. The machine basically incorporated the basic concepts of the spin straightening machines in regard to the support structure for the upper and lower rolls. Accordingly, this machine utilized upper and lower, heavy duty yokes which were pivotally connected by tension rods. The top and bottom rolls were respectively supported by the yokes, and the top rolls were adjusted by mechanisms overlying the top yoke. This assemblage was restrictive in transportability and operation not only because it resulted in an unnecessarily heavy machine, but also one of unnecessary height, thereby unnecessarily increasing the height of the center of gravity.

Such prior roll straightening type machines developed for field application also suffered from their inability to roll straighten the upset ends of drill pipe when they became bent (referred to as hooked ends). The pipe straightener described in the above Canadian patent utilized a form of a reverse gag press in an attempt to straighten hooked ends, but suffered from the same drawbacks above enumerated for early pipe straightening machines of the gag press type. Furthermore, such machines for field usage had no ability to allow visual inspection of the pipe while the pipe was still in the machine. This not only was a time consuming disadvantage, but also was frustrating to operators of the machine.

SUMMARY OF THE INVENTION

The above noted and other drawbacks of the prior art are overcome by providing a method and apparatus for roll straightening pipe which is of particularly lightweight construction and which features the capability to (1) roll straighten hooked, upset pipe ends, (2) gag press straighten pipe, and (3) to visually inspect the pipe while it is still in the pipe straightening machine. Overall weight of the machine is considerably reduced by a novel trough-shaped bed frame for supporting the lower drive rolls and a novel dome-shaped support bonnet removably secured thereto for supporting the upper idler rolls. Up to 8⅝ inch pipe may be accommodated by a machine according to the invention weighing less than fifteen thousand pounds. Further, by controlling orientation of the upper idler rolls laterally of the dome-shaped support structure, overally vertical dimensions of the assemblage is considerably reduced.

According to one aspect of the invention, the mobile pipe straightening machine is of particularly lightweight construction for increased transportability in the field and includes an elongate, trough-shaped bed frame which defines a bed space therein. A drive roll assembly includes at least one power driven drive roll disposed within the bed space and which defines one side of an elonged passage for the pipe to be straightened. The drive roll is positioned in a skewed orientation with respect to the longitudinal axis of the passage. First and second idler roll assemblies are movably coupled to the bed frame and respectively include first and second spaced idler rolls positioned transversely of the axis. The idler rolls define another side of the passage. A driving mechanism is provided for the at least one drive roll to thereby effect a rolling traversal of the pipe needing straightening through the passage.

In a preferred embodiment, the bed frame includes first and second side members which are upstanding from selectively spaced bottom support members. One of the side members has a slot and the driving mechanism includes a drive shaft extending through the slot for turning the drive roll. When using a plurality of drive rolls, all slots are formed in the same side member and all respective drive shafts extending therethrough are directly linked to a single source. This is a feature which allows all the drive rolls to be driven in synchronization.

According to another aspect of the preferred embodiment, the drive roll assembly includes a base plate positioned on one of the bottom members of the bed frame for supporting the drive roll. A pivot pin is secured to the base plate and rotatably extends through one of the bottom members. A slot is provided in the other side member for a positioning mechanism which controls the orientation about the pivot pin of the drive roll.

According to an outstanding feature of the invention, the idler roll assemblies are movably supported within a dome-shaped support structure which is removably secured to the trough-shaped support structure. Each idler roll assembly includes an idler roll housing for the idler roll and the housing is supported within the bell-shaped support structure by a control bushing disposed circumferentially of the housing. A key slot and a key for the key slot are relatively disposed between the bushing and the housing to allow the housing to move through the bushing transversely of the axis of the passage, but to maintain the relative rotational orientation of the housing (and thus the upper idler roll) with respect to the bushing. By placing an aperture in the side of the dome-shaped support structure, and by controlling the orientation of the bushing by a positioning mechanism through the aperture, a considerable reduction in the overall height of the machine is advantageously accomplished.

According to another feature of the invention, each dome-shaped support structure has its own mechanism for advancing the respective idler roll housing transversely of the axis independently of the positions of the other idler roll housings. This allows hooked, upset pipe ends to be roll straightened in the machine during the normal pipe straightening sequence.

According to another feature of the invention, the facility for gag press straightening is alternately provided on the machine. After disabling the roll straightening apparatus and advancing the upper idler rolls away from the passage, a gag press assembly may be actuated. The gag press assembly includes first and second gag press support arms which are pivotal from a position remote from the passage to a position within the passage. In the latter position the arms support the pipe about the length needing straightening. The assembly also includes a power driven ram which is then extended to a position within the passage intermediate the arms for gag press straightening the length of pipe. The gag press mechanism and the roll straightening apparatus are preferably hydraulically driven from a single hydraulic source and actuable only if the other is not being actuated.

According to still another feature of the invention, an inspection mechanism is provided along the passage for elevating the pipe off the drive roll and spinning it without advancing it axially in the passage. This allows visual inspection of the straightness of the pipe while the pipe remains in the machine during the roll straightening process. This mechanism obviates the need for repositioning the pipe in the machine if a previous straightening sequence was ineffective to adequately straighten the pipe.

In the preferred inspection mechanism, a bracket is pivotally connected to the bed frame and has first and second driven rolls circumferentially disposed about either side of a flat edge surface thereof and which are oriented for motion in transverse directions. By pivoting the bracket to a first orientation, one of the driven rolls engages the pipe to advance it longitudinally in the passage. Pivoting the bracket to a second orientation disengages both of the driven rolls from the pipe and is the orientation used during the roll straightening process. By pivoting the bracket to a third orientation, the other of the driven rolls engages the pipe to cause the pipe to spin about the axis in the passage for visually determining the straightness of the pipe.

Accordingly, it is a general object of the present invention to provide a new and improved pipe straightening method and machine of particularly light-weight construction which is especially suited for versatile and effecient field usage.

The above and other objects and advantages of the present invention will become more apparent from a detailed description of preferred embodiments when read in conjunction with the drawings.

DESCRIPTION OF A PREFERRED EMBODIMENT

Figure 1:
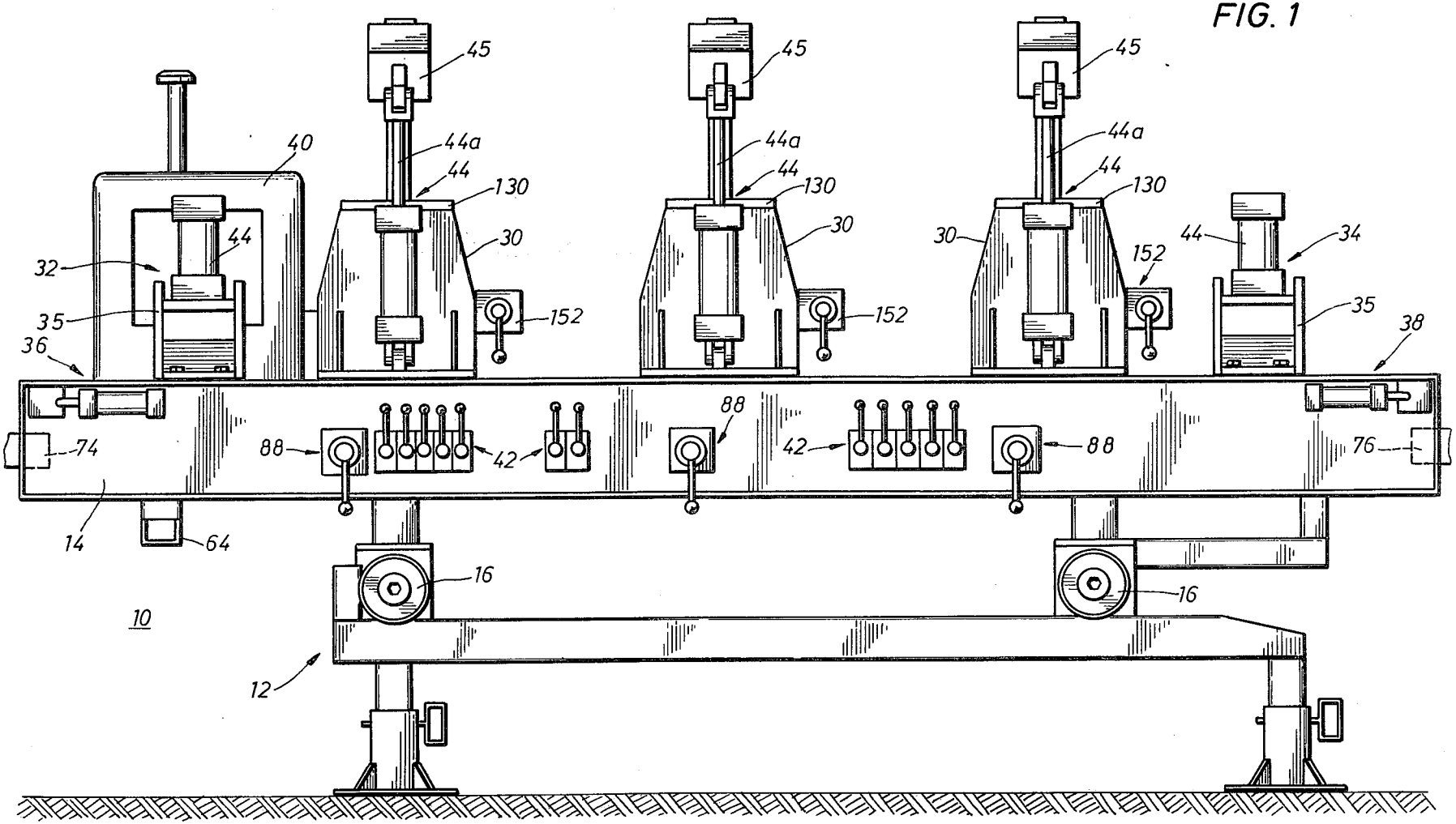
FIG. 1 schematically illustrates a pipe straightening machine of the roll straightening type according to the invention.

Referring now to the drawings, FIG. 1 shows a pipe straightening machine 10 which incorporates features of the invention. The pipe straightening machine 10 is of relatively light-weight construction and finds particular application in on-the-spot, field usages, such as for straightening drill pipe in oil fields. The relative light-weight construction of the machine 10 allows it to be transported on a truck (not shown) and unloaded therefrom onto a sled 12 during the pipe straightening operation.

One of the outstanding features of the machine 10 is the design of its main frame. The chosen design is a primary factor in achieving the weight reduction. The main frame of the design hereinafter described will be referred to as the bed frame 14. As more clearly seen in FIG. 3, the bed frame 14 is constructed in a trough shape, which in the preferred embodiment is U-shaped. This construction provides the strength necessary for straightening up to 8⅝ inch O.D. drill pipe at a considerable weight reduction from prior art mainframes for comparable machines.

Referring again to FIG. 1, the machine 10 includes a set of heavy duty support rollers 16 which are secured to the bed frame 14 for engaging rails 18 of the sled 12. During unloading of the machine 10 from the transportation vehicle, the rollers 16 facilitate positioning of the machine 10 onto the sled 12, and then provide support during the pipe straightening operation.

The machine 10 is of the cros-roll straightening type, featuring at least one lower drive roll 20 (see FIGS. 3 and 4) disposed within the trough of the bed frame 14. At least first and second upper idler rolls 22 (see FIGS. 3 and 5, 5*a*, 5*b*) movably disposed relative to the drive rolls 20. The drive and idler rolls are of hardened steel and define upper and lower sides of an elonged work passage 23 (FIG. 3) a pipe 24 needing straightening. The drive and idler rolls are transversely positioned at skewed orientations with respect to the longitudinal axis of the work passage 23. This allows a given shape for the idler and drive rolls to accommodate a wide range of varying diameter pipe. As more clearly shown in FIGS. 6*a*–6*c*, the idler rolls 22 preferably are longitudinally spaced from the drive rolls 20 along the axis of the work passage.

According to another feature of the invention, the idler rolls 22 are each supported by a dome-shaped idler roll support structure (hereafter referred to as the bonnet 30) which is removably secured to the bed frame 14. As will become more apparent the particular dome-shaped construction of the bonnet 30 effects not only a considerable reduction in the overall weight of the machine 10, but also effects a reduction in the verticle center of gravity, resulting in a more stably transported and operated machine. Furthermore, the particular construction and design of the bonnet 30 wherein they are removably secured (for example by bolts) to the bed frame 14 provides a modular type assemblage which facilitates repair and maintenance of the idler and drive rolls. More specifically, removal of only a few bolts allows the bonnet 30 to be removed as a unit from the bed frame 14 for servicing the idler rolls 22 and for allowing direct access to the drive rolls 20 for removal thereof.

As another feature of the invention, a pair of gag press assemblies 32, 34 are secured to the bed frame 14 at positions along the work passage. The gag press assemblies 32,34 are operated alternately of the roll straightening operations and allows a unit of bent pipe to be either or both roll straightened and gag press straightened upon a single insertion into a machine. Each of the assemblies 32,34 include a dome-shaped bonnet 35, similar in construction and purpose to the bonnet 30.

As still another feature of the invention, inspection equipment is supported along the work passage by the bed frame 14 to allow visual inspection of the pipe 24 after a straightening sequence. The inspection equipment includes inspection units 36,38 (only schematically illustrated in FIG. 1) disposed outwardly of the gag press assemblies 32,34 along the work passage.

The pipe straightening machine 10 is shown in its preferred embodiment as being hydraulically powered. Although other forms of power, such as electrical, may be utilized in accordance with the invention, hydraulic power is preferred for versatility and energy efficiency. The hydraulic system includes an engine 40 which drives valves 42 and hydraulic cylinders 44 constructed and arranged according to standard design principles to effect the described features.

Figure 3:
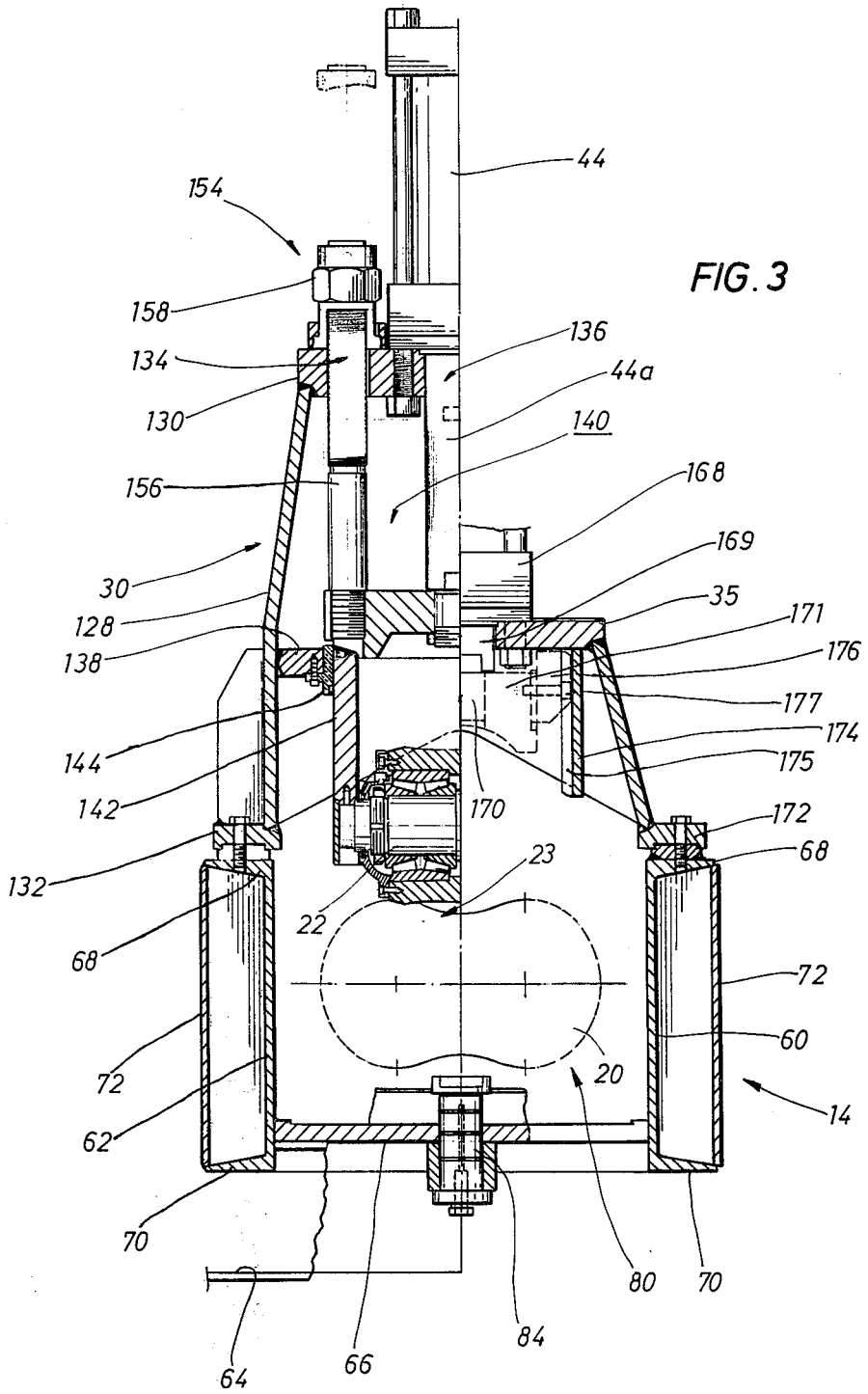
FIG. 3 is a composite, cross-sectional view showing one-half of the trough-shaped bed frame of FIG. 2 in conjunction with a dome-shaped, idler roll support structure and one-half showing the trough-shaped in combination with a dome-shaped gag press support structure and assembly.

Each of the bonnets 30 supports at least one cylinder 44 and its associated rod 44*a* for controlling positioning of the idler roll 22 housed within the bonnet 30. Although not clearly shown, the embodiment shown in FIG. 1 depicts two such hydraulic cylinders 44, joined by a yoke 45, while the embodiment shown in FIG. 3 depicts a single cylinder 44 version. Although either embodiment is suitable, the single cylinder embodiment simplifies the hydraulic system and allows a lighter weight machine 10 to be constructed.

Figure 6A:
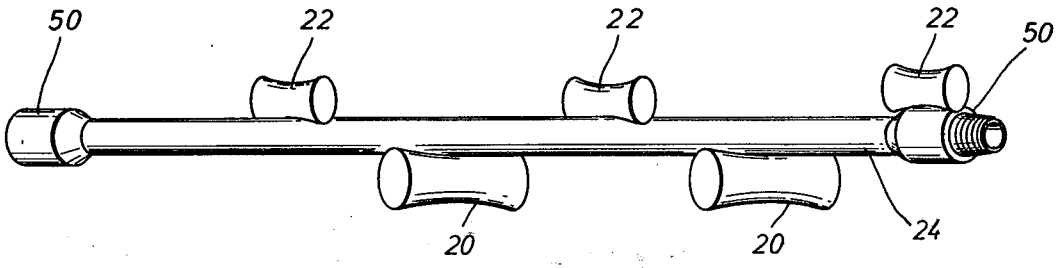
FIGS. 6*a*–6*c* schematically illustrate a pipe, including its upset end, being roll straightened.

Whether using the dual cylinder 44 or single cylinder 44 design, another feature of the machine 10 is that the cylinder(s) for each of the bonnets 30 is independently and separately actuable for controlling the positioning of the respective idler rolls with respect to the work passage. As seen by the schematic sequence in FIGS. 6*a*–6*c*. this allows a pipe 24 having upset ends 50 to be entirely roll straightened. That is, the idler rolls 22 are positioned with respect to the drive rolls 20 to accommodate the particular pipe structure engaging the particular rolls. In FIG. 6*a* the pipe 24 is traversing in a left to right direction, and the leftmost two rolls 22 are relatively close to the drive rolls 20 to accommodate length of pipe intermediate the upset end portions 50 and the rightmost of the rolls 22 is slightly elevated with respect to the other rolls 20 to accommodate the upset end 50. By reversing the rotational direction of the drive rollers 20, during operation, the pipe reciprocally advances to accomplish roll straightening of the upset end 50.

Figure 6B:
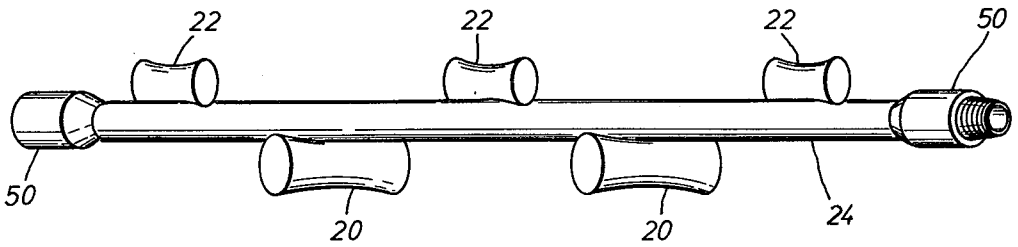

When the end 50 has been straightened, the rightmost idler roll is lowered towards the axis of the work passage to an elevation for accommodating the pipe length intermediate the end portions 50 (as shown in FIG. 6*b*). When the length intermediate the end portions 50 has been roll straightened, the leftmost of the idler rolls 22 is relatively elevated for roll straightening the left upset end of the pipe 24 (FIG. 6*c*), preferably in a reciprocatory motion.

The Bed Frame 14 and the Drive Rolls 20

Figure 2A:
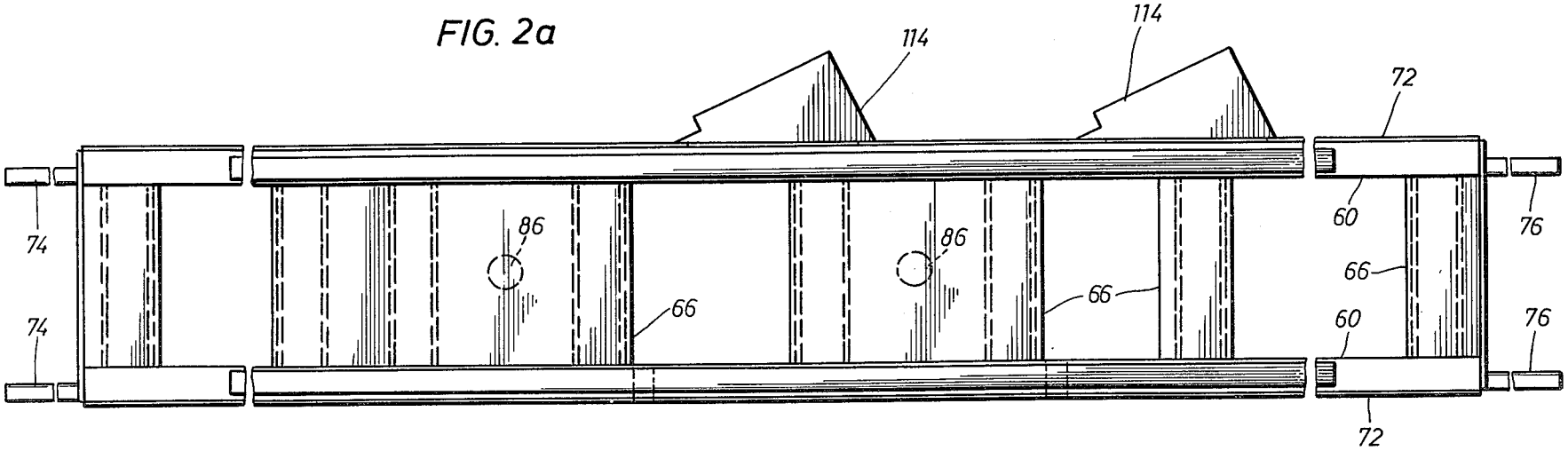
FIGS. 2*a* and 2*b* respectively are plan and elevational views of a trough-shaped bed frame utilized by the pipe straightening machine of FIG. 1.
Figure 2B:
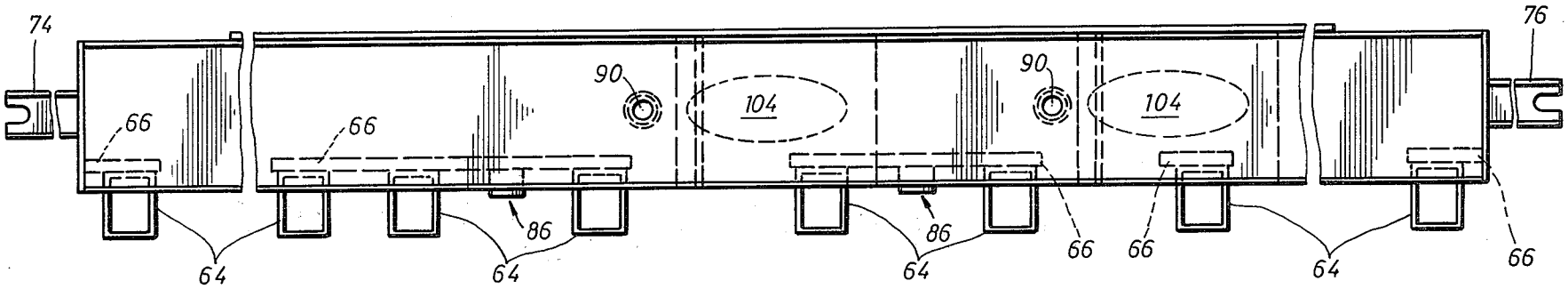
Figure 4:
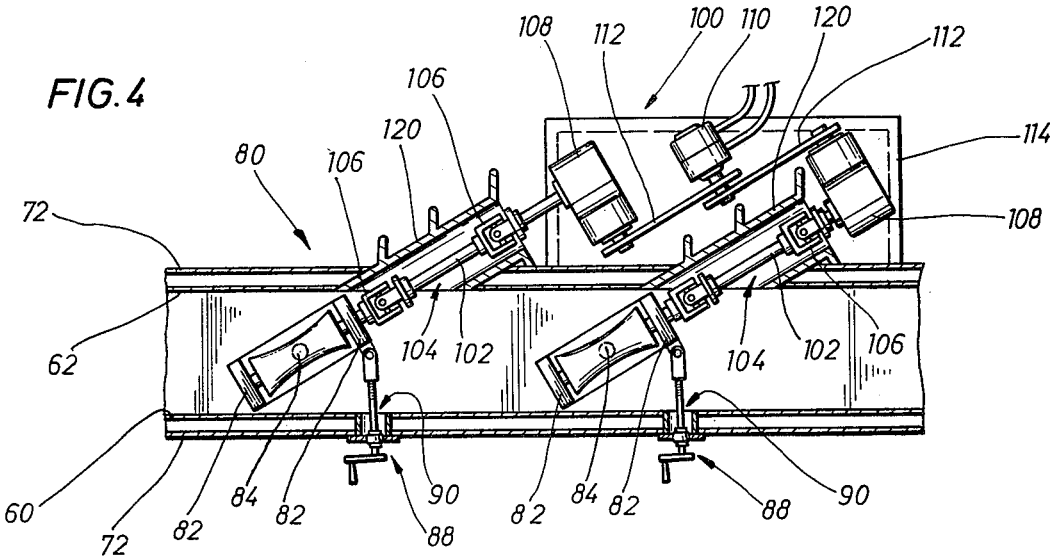
FIG. 4 is a schematic drawing of a plan view of a pair of drive rollers and driving apparatus therefor in association with the trough-shaped bed frame.

The bed frame 14 and the drive rolls 20 are shown in more detail in FIGS. 2–4. FIGS. 2*a* and 2*b* respectively show plan elevational views of the bed frame 14; FIG.

3 shows a composite view of a cross-section showing the bed frame 14 relative to the drive roll 20 (in phantom); and FIG. 4 shows a cutaway plan view of the bed frame 14 in association with the drive roll 20.

The bed frame 14 includes side members 60,62 which are upstanding from a plurality of traverse tubes 64. A plurality of bottom members 66 are selectively secured to the side members 60,62 and to the traverse tubes 64 as will be discussed in more detail subsequently.

The side members 60,62 preferably have upper and lower flanges 68,70 respectively. An outer support member 72 is secured to the outer edge of the flanges 68,70 for providing further support to the bed frame 14. Also coupled to the upstanding side members 60,62 are pairs of roller guide supports 74,76. The supports 74,76 are disposed at each end of the bed frame 14 (and thus at the ends of the work passage) for supporting roller guides (not shown in FIG. 1) which in turn supports the pipe 24 as it enters and exits the work passage.

The members 60, 62, 66, 72, 74 and 76 are preferably all comprised of steel plate welded or otherwise secured together. Thicknesses of the various plates are chosen to accommodate the stresses supplied by the cylinders 44 (and the maximum diameter of the pipe to be straightened).

Referring now to the drive rolls 20, each drive roll 20 is a part of a drive roll assembly 80 which is cooperatively associated with the bed frame 14. In addition to the drive roll 20, each drive roll assembly 80 also includes pillow blocks 82 into which the drive roll 20 is journaled, a pivot pin 84 coupled to the pillow blocks 82 and pivotally extending through an aperture 86 in the corresponding bottom member 66 of the bed frame 14. A positioning mechanism 88 is also included. The positioning mechanism 88 is coupled to the pillow block 82 and extends through an aperture 90 in the side member 60 and in the outer support member 72. This arrangement allows the respective drive roll 20 to be reoriented with respect to the axis of the work passage by a mechanism positioned laterally of the bed frame 14.

A drive mechanism 100 is coupled to the bed frame 14 for driving, or turning, the drive rolls 20 and thereby advancing the pipe 24 through the work passage. The drive mechanism 100 includes a plurality of drive shafts 102 extending through apertures 104 in the side member 62 (and through its corresponding outer support member 72) different from the support member 62 having the aperture 90. The drive shafts 102 have universal joints 106 at each end thereof for respectively coupling the shaft 102 to the drive roll 20 and to a gear box 108. Each gear box 108 is driven from a common hydraulic motor by way of a chain or belt 112. The gear box 108 and the motor 110 are mounted on a support member 114 secured to the bed frame 14.

The described association of the drive mechanism 100 to the drive rolls 20 and to the bed frame 14 is a feature of the present invention which allows the drive rolls 20 to be turned in synchronism. This provides the smoothest and most efficient transporting of the pipe along the passage. Further, by placing the positioning mechanisms 88 exclusively on one side of the bed frame 14 and by positioning the drive mechanisms 100 on the other side of the bed frame 14, the operator of the machine 10 is at a safe distance from the drive mechanism 100 while operating the positioning mechanisms 88.

To strengthen the regions of the members 62, 72 at the locations having the apertures 104, the bed frame 14 further includes drive shaft housings 120 extending through and from the apertures 104 and which are secured to the members 62,72. Because the rolls 20 are skewed with respect to the work passage, the housings 120 join the members 62,72 at an angle. In the preferred embodiment, this angle is 25°.

The Idler Rolls 22 and the Bonnet 30

Figure 5A:
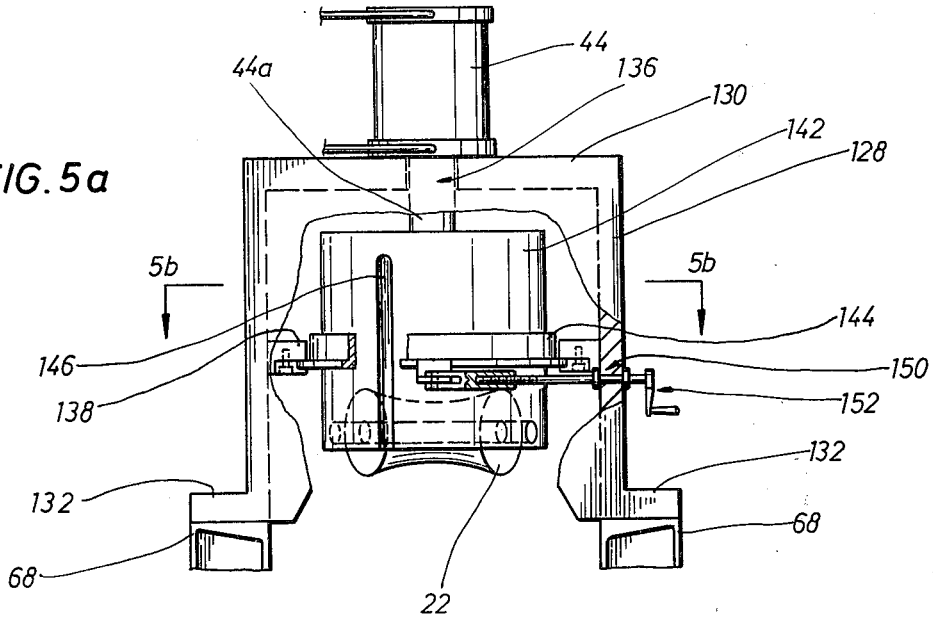
FIGS. 5*a* and 5*b* are elevation and plan cross-sectional views of the dome-shaped support structure and its associated idler roll assembly.
Figure 5B:
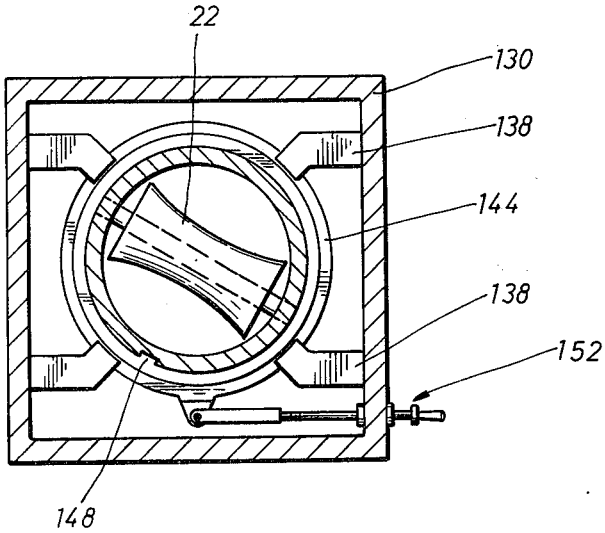
Figure 6C:
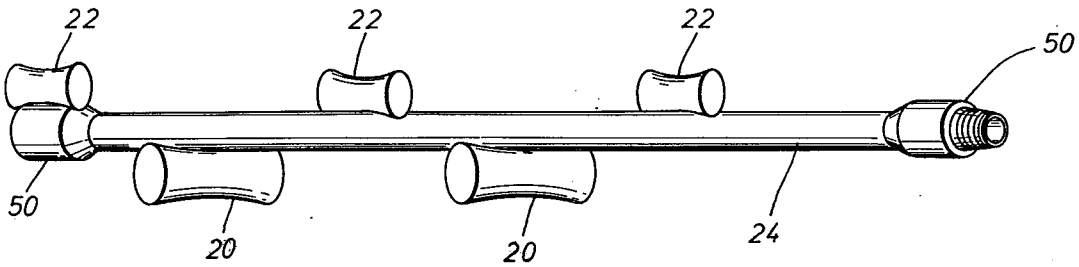

The idler rolls 22 and the bonnet 30 are shown in more detail in FIGS. 3, 5*a* and 5*b*. In viewing FIG. 3, it is understood that a composite of the cross-section of the bed frame 14 and the bonnets 30,35 is shown; that is, the upper left quadrant of the drawing shows the bonnet 30 and associated structure as it mounts to the bed frame 14 (shown in the lower lefthand quadrant). Further, it is understood that the view shown in FIG. 3 is not through a single vertical plane, as a given drive roll 20 does not directly underlie a corresponding idler roll 22. Accordingly the lefthand, composite view of FIG. 3 is of a first vertical plane cutting the idler rolls 22 (the upper left quadrant) and of a second vertical plane cutting through the pivot pin 84 (the lower lefthand quadrant). All elements cut by the vertical center line of FIG. 3 are symmetrical about the center line. For convenience only the lefthand parts of these elements are shown in the upper left quadrant of FIG. 3.

The bonnet 30 includes an outer shell 128 of reinforced steel having an upper mounting surface 130 and a circumferentially disposed flange 132 which is removably securable to the flanges 68. The mounting surface 130 includes bores 134,136 which will be explained in more detail subsequently. Inside the bonnet 30 a support ring 138 is secured to the outer lateral shell 128 intermediate the mounting surface 130 in the flange 132.

As previously mentioned with respect to FIG. 1, each bonnet 30 supports one or more of the hydraulic cylinders 44. In the embodiment shown in FIG. 3, the bonnet 30 has a single cylinder 44 bolted thereto which is positioned through the aperture 136.

Referring now to the idler rolls 22, each idler roll 22 is a part of an idler roll assembly 140 which is cooperatively associated with the bonnet 30 (and thus with the bed frame 14 and the work passage 23). In addition to the idler rolls 20, each idler roll assembly 140 includes an idler roll housing 142 which carries the idler roll 120 and associated bearing structure. The assembly 140 further includes a control bushing 144 which circumferentially supports the housing 142 and is in rotational engagement with the support ring 138. The control bushing 138 and the housing 142, define therebetween a key slot 146 and a tab or a key 148 for the key slot 146. The key slot 146 is positioned transverse to the longitudinal axis of the passage to allow the idler roll housing 142 (and thus the idler roll 122) to be advanced to positions relatively close to and away from the drive roll 20. The key 148 which rides within the slot 146 causes the housing 142 to be held in the same rotational orientation as that of the control bushing 144.

To control the rotational orientation of the bushing 144 and thus of the housing 142, an aperture 150 is cut into the outer lateral shell 128 and a positioning mechanism 152 is secured to the shell 128 through the aperture 150. The positioning mechanism 152 is coupled to the control bushing 144 for turning it and for otherwise controlling its orientation with respect to the work passage.

Use of such a control bushing 144 and the positioning mechanism 152 are features of the invention. The control bushing 144 serves to resist lateral forces exerted on the housing 142 due to advancing of the pipe 24 during the straightening process, thereby effectively reducing the bending moment created by the pipe 24 on the housing 142. The bushing 144 also functions as a unit for angularly adjusting the orientation of the rolls 22 with respect to the work passage. By using the positioning mechanism 152 through the aperture 150, control of the bushing 144 is effected laterally of the roll 22 rather than from a position overlying the roll 22 as utilized in prior art pipe straightening machines. This reduces the required overall height of the machine 10 and provides a lower center of gravity.

The housing 142 is coupled to the hydraulic cylinder 44 to enable the vertical advancement within the bonnet 30 necessary (1) to accommodate pipes 24 of different outside diameters, and (2) in using the gag press assemblies 32,34 and the inspection units 36,38. To control the travel of the housing 142, a stop mechanism 154 including a bar 156 of changeable length is connected to the housing 142. The bar 156 extends through the bore 134 and has a threaded end on which a nut 158 is adjustably secured. By advancing the nut 158 to various positions, the amount of travel of the rod 44*a* of the cylinder 44 is controlled, thereby controlling the elevation of the idler rolls 22 above the passage 23.

The Gag Press Assemblies 32,34

Figure 7A:
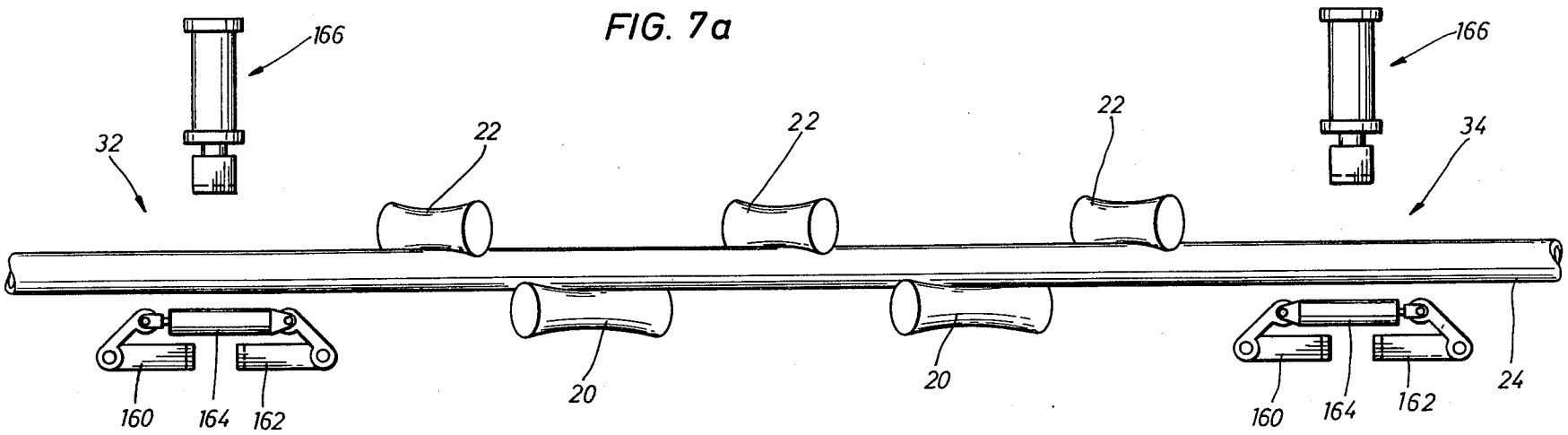
FIGS. 7*a* and 7*b* schematically illustrate gag press assemblies and their operation in accordance with the roll straightening sequence.
Figure 7B:
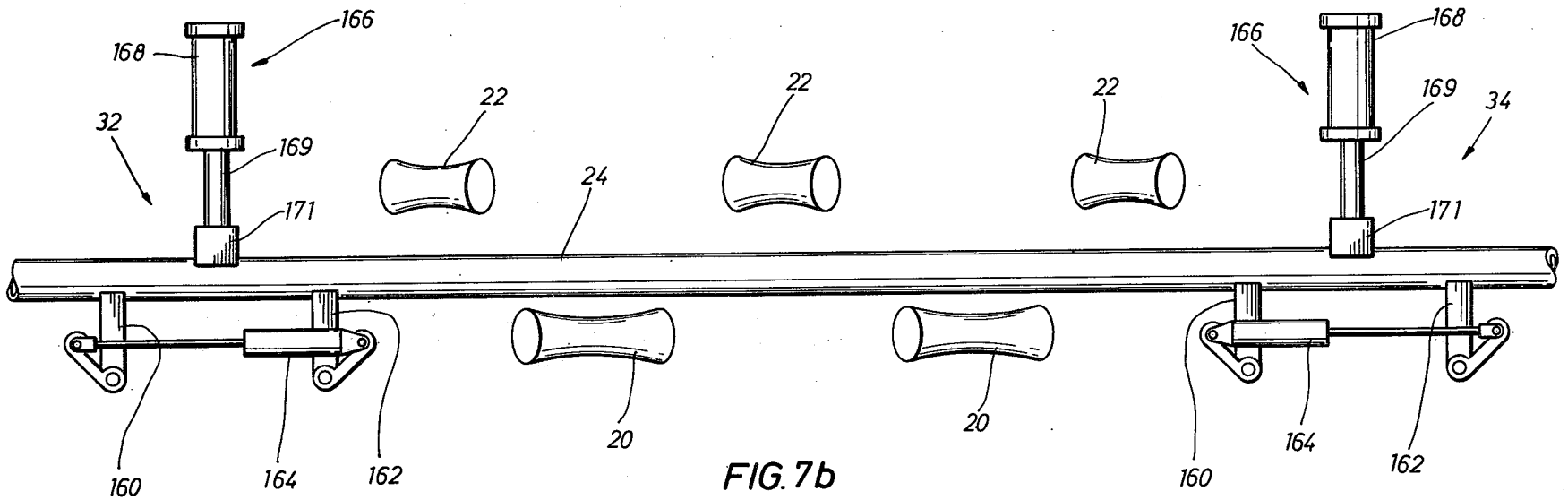

Referring now to FIGS. 3, 7*a* and 7*b*, the gag press assemblies 32,34 are shown in association with the rolls 20,22 and a pipe 24 needing straightening. It is understood that FIG. 3 is a composite cross-sectional view, with the upper right section being of the dome 35 and the lower right section being of the bed frame 14. Similar to the left sections of FIG. 3, the upper and lower right sections are taken through different vertical planes, as the drive roll 20 is spaced along the axis of the passage 23 from the gag press assembly.

The gag press assemblies 32,34 are separately and independently actuable from the roll straightening procedure and may only be operated by the valves 42 when roll straightening is not being performed.

The assemblies 32,34 include first and second support arms 160,162 which are pivotally connected to the bed frame. The arms 160,162 have ends which are pivotal from a position relatively away from the work passage to a position substantially within the work passage. An actuator 164, shown in the form of a hydraulic cylinder, has one end coupled to each of the arms 160,162 and, when operated, effects pivoting thereof to lift the pipe 24 off the drive rolls 20.

The assemblies 32,34 further include a ram 166 in the form of a hydraulic cylinder 168 and 170 therefor. A cylinder rod extension 170 is screwed into the cylinder rod 170, and a steel block 171 is screwed onto the extension 170. The steel block 171 engages the pipe needing to be straightened when the cylinder 168 is actuated.

The dome-shaped gag press bonnet 35 supports the hydraulic cylinder 168 and the rod 169 extends through an aperture therein. The bonnet 35 is comprised of a flange 172 which is removably secured to the flange 68 of the bed frame 14. The bonnet 35 further includes an inner guide plate 174 which has a groove 175. An adapter 176 is mounted to the block 171 by a bolt 177 and rides within the groove 175.

In operation, when the arms 160,162 have been actuated to lift and support the pipe 24, the rod 169 is advanced and the block 170 is forced into the work passage intermediate the arms 160,162 for straightening the pipe 24 according to well known gag press principles.

Providing the machine 10 with the capacity to either roll straighten pipe or to gag press straighten pipe has proven to be a time saving convenience. Both operations can be performed with only a single insertion of the pipe 24 into the machine 10, obviating set-up times otherwise required.

The Inspection Units 36

Figure 8A:
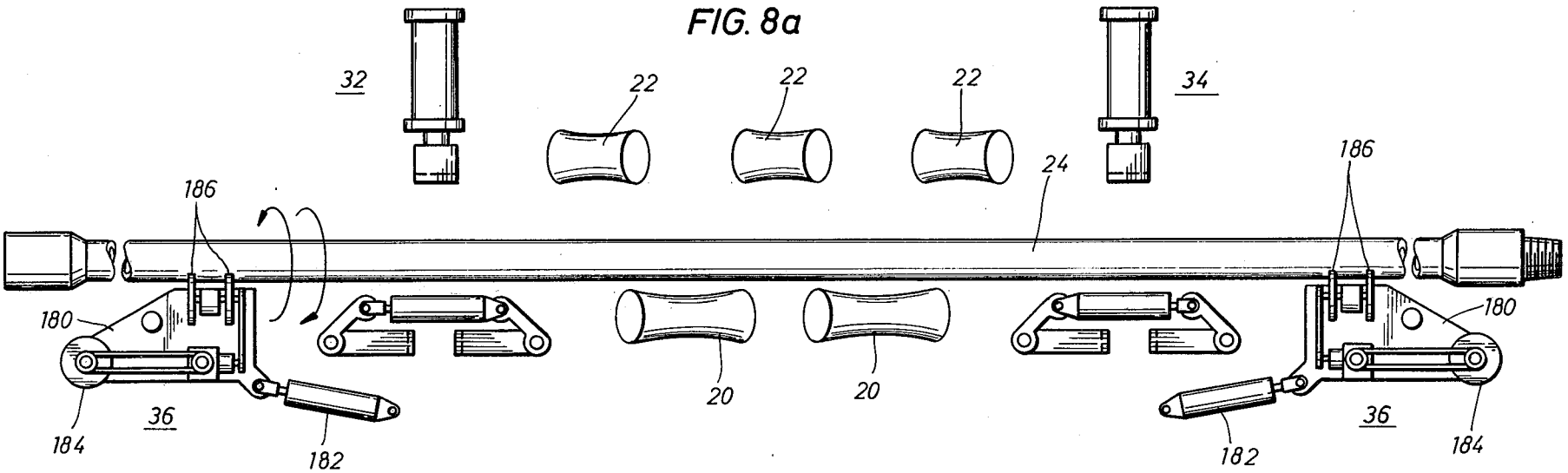
FIGS. 8*a* and 8*b* schematically illustrate inspection equipment and its operation in association with the roll straightening sequence.
Figure 8B:
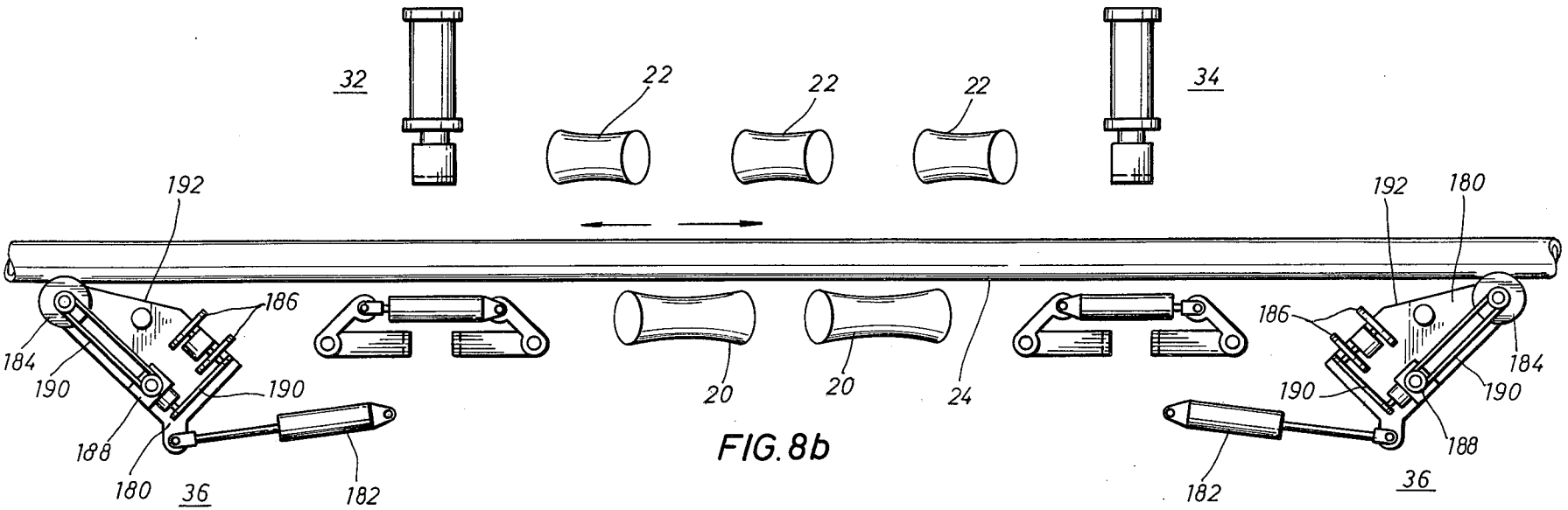

Referring now to FIGS. 8*a*, 8*b* the inspection units 36 are shown in association with the gag press assemblies 32,34, the rolls 20,22 and the pipe 24 needing straightening. The inspection units 36 each include a bracket 180 pivotally connected to the bed frame 14 and an actuator 182 (shown in the form of a hydraulic cylinder) for advancing the bracket 180 about its pivot point.

Each bracket 180 supports a pair of driven rollers 184,186 positioned for rotation in directions transverse to one another. The roller 184 is positioned for advancing the pipe 24 axially through the work passage, and the roller 186 is positioned to roll the pipe 24 about the axis of the passage without advancing it along the passage. The rollers 184,186 are driven by a hydraulic motor 188 via belts or chains 190.

The rollers 184,186 are circumferentially mounted on the bracket 180 and are separated by an intermediate edge portion 192. Compared to the positions on the bracket 180 of the rollers 184,186, the edge portion 192 is relatively close to the pivot point for the bracket 180. This provides the bracket 180 to have three orientations about its pivot point during operation: (1) a first orientation as shown in FIG. 8*b* whereby the rollers 184 are advanced into engagement with the pipe 182 for lifting it off the drive rollers 20 and for advancing it along the work passage; (2) a second orientation whereby the edge portion 192 is substantially parallel to the axis of the pipe 24 so that both rollers 184,186 are disengaged from the pipe 24; and (3) a third orientation such that the rollers 186 are in engagement with the pipe 24 (as shown in FIG. 8*a*) for rendering the rolling movement to the pipe 24 without advancing it along the work passage.

Provision of the inspection units 36 is an outstanding feature which obviates the drawbacks of prior art machines requiring the straightened pipe 24 to be removed from the machine 10 for visual inspection as to the quality of the straightening. The units 36 not only eliminate such a time consuming drawback, but also eliminate the frustrations to the operator of the machine 10 when the pipe 24 must repeatedly be taken out of and reinserted into the machine 10 for additional straightening.

It thus will be appreciated that a mobile pipe straightener has been described which is of particularly lightweight construction for increased transportability in the field. Up to 8⅝ inch pipe can be roll straightened by a machine weighing less than 15,000 pounds. The minimization of the weight of the machine 10 results from using a novel, trough-shaped bed frame for supporting the drive rolls and by using a novel dome-shaped support bonnet of a modular construction for each idler roll. A novel control bushing and associated control apparatus therefor are utilized for controlling the orientation of the idler rolls, thereby effectively lowering the center of gravity of the machine 10. Other outstanding features of the machine include individual control of the upper idler rolls to allow roll straightening of hooked, upset pipe ends; separately actuable gag press assemblies; and an inspection mechanism which allows the pipe to be visually inspected subsequent to a straightening sequence while the pipe is still in the machine.

Although several preferred embodiments have been described in a fair amount of detail, it is understood that such detail has been for clarification purposes. Various modifications and changes will be apparent to one having ordinary skill in the art without departing from the spirit and scope of the invention as hereinafter set forth in the claims.

What is claimed is:

1. A mobile pipe straightening machine of particularly light-weight construction for increased transportability in field usage, comprising:

(a) an elongate, trough-shaped bed frame defining a bed space therein;

(b) a drive roll assembly including at least one power driven drive roll disposed within the bed space and which defines one side of an elongate passage for the pipe to be straightened, said drive roll being in a skewed orientation with respect to the longitudinal axis of said passage;

(c) first and second idler roll assemblies movably coupled to the bed frame and respectively including first and second spaced idler rolls positioned transversely of said axis and defining another side of the passage; and (d) means for driving said at least one drive roll to thereby effect a rolling traversal of said pipe through the passage.

2. The mobile pipe straightening machine of claim 1 wherein said bed frame includes first and second side members upstanding from a bottom support, wherein one of said side members has a slot, and wherein said means for driving includes a drive shaft extending through said slot for turning said drive roll.

3. The mobile pipe straightening machine of claim 1 wherein said drive roll assembly includes:

(a) a base plate for supporting said one roll and (b) a pivot pin secured to said base plate and rotatably extending through a bottom surface of said bed frame.

4. The mobile pipe straightening machine according to claim 1 and including a dome-shaped support structure removably secured to said bed frame, wherein one of said idler rolls is movably secured within said dome-shaped support structure for positioning adjacent said passage.

5. The mobile pipe straightening machine according to claim 4 and including another said dome-shaped support structure coupled to the bed frame for supporting the other of the idler rolls, and wherein said idler roll assemblies each further includes an individually controllable, power-driven, idler roll housing for supporting each idler roll and which allows each idler roll to be separately adjusted transversely of said axis during the pipe straightening process, thereby allowing hooked, upset pipe ends to be roll straightened.

6. The mobile pipe straightening machine according to claim 5 and further including means for advancing said idler roll housing, the advancing means comprising:

(a) a fluid actuated cylinder having one end secured to said dome-shaped support structure and a cylinder rod thereof coupled to said housing;

(b) a stop mechanism for adjustably controlling the travel of the rod and thus the magnitude of the advancing of the housing; and (c) a bushing circumferentially coupled around said housing in movable engagement with said dome-shaped support structure.

7. The mobile pipe straightening machine according to claim 6 wherein the housing and the bushing include a key slot and a key for the key slot cooperatively extending therebetween, said key slot disposed to allow said transverse advancing of the housing.

8. The mobile pipe straightening machine according to claim 7 wherein said bushing further includes a tab and wherein said dome-shaped support structure includes an aperture, and wherein said idler roll assemblies each further include means extending through said aperture and operable from outside of said dome-shaped support structure for changing the orientation of said bushing with respect to said dome-shaped support structure, thereby changing the orientation of said idler rolls with respect to said passage.

9. The mobile pipe straightening machine according to claim 2 wherein there are a plurality of said drive rolls and a corresponding plurality of said slots, and all said slots are in the same side member, and wherein said driving means includes a plurality of said drive shafts coupled to a single driving mechanism, said drive rolls thereby being driven synchronously.

10. The mobile pipe straightening machine according to claim 1 and including a separately actuable gag press assembly coupled to said bed frame, the gag press assembly including:

(a) first and second support arms pivotally connected to the bed frame and having ends pivotal from a position away-from said passage to a position within said passage, and (b) a power-driven ram extendable to a position within said passage intermediate said ends.

11. The mobile pipe straightening machine according to claim 10 wherein said ram and said drive roll drive means are hydraulically driven, and including a single hydraulic source for alternately driving said ram and said drive roll drive means.

12. The mobile pipe straightening machine according to claim 1 and including an inspection mechanism coupled to the bed frame for elevating a pipe in the passage off said drive roll and for rolling the pipe about said axis without advancing it axially in the passage.

13. The mobile pipe straightening machine according to claim 12 wherein the inspection mechanism includes a pivotally connected bracket having first and second spaced and driven rollers, the rollers driven in directions transverse to one another to thereby alternately effect said rolling of the pipe about the axis and advancing of the pipe along the passage, wherein the mechanism is pivotal to a first position which causes one of the rollers to engage a pipe within the passage, is pivotal to a second position to allow only the other of the rollers to engage the pipe, and is pivotal to a third position to disengage both rollers from the pipe.

14. In a mobile pipe straightening machine of the roll straightener type having moveable upper and lower roll assemblies to define therebetween a work passage for receiving and straightening pipe, wherein the upper roll assembly includes at least first and second idler rolls disposed along the work passage and individually moveable in a direction transverse to the longitudinal axis of the work passage, and wherein the lower roll assembly includes at least one drive roll adjacent to the work passage and skewed in orientation with said axis the method comprising the steps of:

(a) advancing one of the idler rolls to a position relatively proximate said axis to define a segment of the work passage to have a cross-sectional dimension to receive the length of pipe intermediate the ends;
(b) advancing the other of the idler rolls to a position more remote from said axis than one said idler roll to define another segment of the passage to have a cross-sectional dimension to receive the upset end of the pipe;
(c) rotating the drive roll to rollingly advance the pipe along the work passage, between the rolls, whereby said other of the idler rolls roll straightens the upset end;
(d) selectively positioning first and second support arms along said passage; and
(e) advancing a ram into said work passage intermediate said support arms to thereby effect alternate operations of roll straightening and gag straightening.

15. The method according to claim 14 wherein the step of advancing the ram includes the steps of:
(a) discontinuing the rotating of the drive roll, and
(b) advancing the idler rolls to a position away from said axis.

16. The method according to claim 14 wherein said step of rotating comprises the step of bidirectionally rotating the drive roll to reciprocally advance said pipe.

17. A mobile pipe straightening machine particularly of light-weight construction for increased transportability in field usage, comprising:
(a) a supporting main frame;
(b) a drive roll assembly including at least one power driven drive roll pivotally supported by the main frame and which defines one side of an elongated passage for the pipe to be straightened, said drive roll being a skewed orientation with respect to the longitudinal axis of said passage;
(c) a pair of cavity defining dome-shaped idler roll support structures removably secured to said main frame at positions along said axis which are spaced from said drive roll assembly;
(d) first and second idler roll assemblies respctively supported within each said cavity of the dome-shaped idler roll support structures for movement transverse to said axis, the idler roll assemblies each including an idler roll positioned in a skewed orientation with said axis and defining another side of said passage; and
(e) means for driving said at least one drive roll to thereby effect a rolling traversal of said pipe through the passage.

18. The mobile pipe straightening machine according to claim 17 wherein said idler roll assemblies each include:
(a) an idler roll housing within said dome-shaped support structure;
(b) a bushing circumferentially secured around said housing and movably engaged with said dome-shaped support structure; and
(c) drive means coupled to said dome-shaped support structure for advancing the housing and thus the respective idler roll to positions remote from and adjacent said axis.

19. The mobile pipe straightening machine according to claim 18 wherein said dome-shaped support structure has an aperture lateral of said bushing, and said idler roll assembly include means extending through said aperture for rotating said bushing within the dome-shaped support structure and thus for controlling the orientation of the respective idler roll with respect to said axis.

20. The mobile pipe straightening machine according to claim 18 wherein the bushing and the housing include a key slot and a key for the key slot operatively engageable therebetween.

21. A mobile pipe straightening machine of particularly light-weight construction for increased transportability in field usage, comprising:
(a) a main frame,
(b) a drive roll assembly including at least one power driven drive roll pivotally supported by the main frame and which defines one side of an elongated passage for the pipe to be straightened, said drive roll being in a skewed orientation with respect to the longitudinal axis of said passage;
(c) at least first and second idler roll assemblies movably supported adjacent said main frame for movement transverse to said axis, the idler roll assemblies each including first and second spaced idler rolls positioned in a skewed orientation with said axis and defining another side of said passage;
(d) pipe inspection equipment disposed along said passage for elevating the pipe off the drive roll and effecting rolling of the pipe about the axis without advancing it along the passage, the inspection equipment including first and second brackets pivotally supported to the main frame at locations spaced along the work passage, each said bracket supporting a first driven roll for effecting said rolling of the pipe without advancing and also including a second driven roll for selectively advancing the pipe along the passage; and
(e) means for driving said at least one drive roll to thereby effect a rolling traversal of said pipe through the passage during roll straightening.

22. The mobile pipe straightening machine according to claim 21 wherein said first and second driven rolls are mounted at circumferentially spaced positions on said bracket such that when the first drive roll engages the pipe, the second drive roll is disengaged therefrom and conversely.

23. The mobile pipe straightening machine according to claim 22 wherein said bracket is configured to have an edge of its circumference between said first and second drive rolls such that when the bracket is oriented with said edge adjacent the pipe, neither of said drive rolls engage the pipe.

24. A mobile pipe straightening machine of particularly light-weight construction for increased transportability in field usage, comprising:
(a) a main frame;
(b) a drive roll assembly including at least one power driven drive roll pivotally supported by the main frame and which defines one side of an elongated passage for the pipe to be straightened, said drive roll being in a skewed orientation with respect to the longitudinal axis of said passage;
(c) at least first and second idler roll assemblies movably supported adjacent said main frame for movement transverse to said axis, the idler roll assemblies each including first and second spaced idler rolls positioned in a skewed relationship with said axis and defining another side of said passage;
(d) a gag press assembly disposed along said passage and including at least first and second movably supported arms each pivotal from a position remote from said passage to a position adjacent thereto for supporting said pipe during gag pressing thereof, and further including a ram having an element movable from a position remote from said passage to a position adjacent said passage and intermediate said arms; and (e) means for driving said at least one drive roll to thereby effect a rolling traversal of said pipe through the passage.

25. The mobile pipe straightening machine according to claim 24 wherein said gag press assembly includes a fluid operated cylinder coupled to one of said arms, the cylinder having a rod which is coupled to the other of said arms such that upon actuation of the cylinder the arms are pivoted from the remote position to the adjacent position and conversely.

26. A mobile pipe straightening machine of particularly light-weight construction for increased transportability in field usage, comprising:

(a) a main frame;

(b) a drive roll assembly including at least one power driven roll pivotally supported by the main frame and which defines one side of an elongated passage for the pipe to be straightened, said drive roll being in a skewed orientation with respect to the longitudinal axis of said passage;

(c) at least first and second idler roll assemblies moveably supported adjacent said main frame for movement transverse to said axis, the idler roll assemblies each including first and second spaced idler rolls positioned in a skewed orientation with said axis and defining another side of said passage;

(d) pipe inspection equipment diposed along said passage for elevating the pipe off the drive roll and effecting rolling of the pipe about the axis without substantial advancement of it along the passage, the inspection equipment including a first driven roll having its major axis disposed substantially along the longitudinal axis of the passage for effecting said rolling of the pipe without advancing it and also including a second driven roll for selectively advancing the pipe along the passage; and (e) means for driving said at least one drive roll to thereby effect a rolling traversal of said pipe through the passage during roll straightening.

27. A mobile pipe straightening machine of particularly light-weight construction for increased transportability in field usage, comprising:

(a) an elongate, trough-shaped bed frame defining a bed space therein;

(b) a drive roll assembly including at least one power driven drive roll disposed within the bed space and which defines one side of an elongate passage for the pipe to be straightened;

(c) first and second idler roll assemblies moveably coupled to the bed frame and respectively including first and second spaced idler rolls positioned transversely of said axis and defining another side of the passage; and (d) means for driving said at least one drive roll to thereby effect a rolling traversal of said pipe through the passage.

28. The mobile pipe straightening machine according to claim 27 and including a separately actuable gag press assembly coupled to said bed frame, the gag press assembly including:

(a) at least one support member supported by the bed frame and having an end moveable from a position away-from said passage to a position within said passage, and (b) a power-driven ram extendable to a position within said passage proximate said end.

29. The mobile pipe straightening machine according to claim 27 and including an inspection mechanism coupled to the bed frame for elevating a pipe in the passage off said drive roll and for rolling the pipe about said axis without substantially advancing it axially in the passage.

30. A mobile pipe straightening machine particularly of light-weight construction for increased transportability in field usage, comprising:

(a) a supporting main frame;

(b) a drive roll assembly including at least one power driven drive roll supported by the main frame and which defines one side of an elongated passage for the pipe to be straightened;

(c) a pair of cavity defining dome-shaped idler roll support structures removeably secured to said main frame at positions along said axis which are spaced from said drive roll assembly;

(d) first and second idler roll assemblies respectively supported within each said cavity of the dome-shaped idler roll support structures for movement transverse to said axis, the idler roll assemblies each including an idler roll which defines another side of said passage; and (e) means for driving said at least one drive roll to thereby effect a rolling traversal of said pipe through the passage.

31. A mobile pipe straightening machine of particularly light-weight construction for increased transportability in field usage, comprising:

(a) a main frame;

(b) a drive roll assembly including at least one power driven drive roll pivotally supported by the main frame and which defines one side of an elongated passage for the pipe to be straightened;

(c) at least first and second idler roll assemblies moveably supported adjacent said main frame for movement transverse to said axis, the idler roll assemblies each including first and second spaced idler rolls positioned along said axis and defining another side of said passage;

(d) a gag press assembly disposed along said passage and including at least one support member moveable from a position remote from said passage to a position adjacent thereto for supporting said pipe during gag pressing thereof, and further including a ram having an element moveable from a position remote from said passage to a position adjacent said passage and proximate said member; and (e) means for driving said at least one drive roll to thereby effect a rolling traversal of said pipe through the passage.

32. In a mobile pipe straightening machine of the roll straightener type having moveable upper and lower roll assemblies to define therebetween a work passage for receiving and straightening pipe, wherein the upper roll assembly includes at least first and second idler rolls disposed along the work passage and individually moveable in a direction transverse to the longitudinal axis of the work passage, and wherein the lower roll assembly includes at least one drive roll adjacent to the work passage the method comprising the steps of:

(a) advancing one of the idler rolls to a position relatively proximate said axis to define a segment of the work passage to have a cross-sectional dimension to receive the length of pipe intermediate the ends;

(b) advancing the other of the idler rolls to a position more remote from said axis than one said idler roll to define another segment of the passage to have a cross-sectional dimension to receive the upset end of the pipe;

(c) rotating the drive roll to rollingly advance the pipe along the work passage, between the rolls, whereby said outer of the idler rolls roll straightens the upset end;

(d) selectively positioning at least one support member along said passage; and (e) advancing a ram into said work passage proximate said support member to thereby effect alternate operations of roll straightening and gag straightening.

33. A mobile pipe straightening machine of particularly light-weight construction for increased transportability in field usage, comprising:

(a) a main frame;

(b) a drive roll assembly including at least one power driven roll supported by the main frame and which defines one side of an elongated passage for the pipe to be straightened;

(c) at least first and second idler roll assemblies moveably supported adjacent said main frame for movement transverse to said axis, the idler roll assemblies each including first and second spaced idler rolls positioned to define another side of said passage;

(d) pipe inspection equipment disposed along said passage for elevating the pipe off the drive roll and effecting rolling of the pipe about the axis without substantial advancement of it along the passage, the inspection equipment including a driven inspection roll having its major axis disposed for effecting said rolling of the pipe without substantially advancing it; and (e) means for driving said at least one drive roll to thereby effect a rolling traversal of said pipe through the passage during roll straightening.

* * * * *